US005385037A

United States Patent [19]

Bae

[11] Patent Number: 5,385,037

[45] Date of Patent: Jan. 31, 1995

[54] FULLY-AUTOMATED WASHING MACHINE

[75] Inventor: Sang-Chul Bae, Suwon-city, Rep. of Korea

[73] Assignee: Samsung Electronics Co., Ltd., Suwon City, Rep. of Korea

[21] Appl. No.: 80,874

[22] Filed: Jun. 24, 1993

[30] Foreign Application Priority Data

Jun. 24, 1992 [KR] Rep. of Korea ..... 92-11003
Jun. 29, 1992 [KR] Rep. of Korea ..... 92-11480

[51] Int. Cl.[6] ..... D06F 31/00
[52] U.S. Cl. ..... 68/16; 68/27
[58] Field of Search ..... 68/15, 16, 26, 27

[56] References Cited

U.S. PATENT DOCUMENTS 310,507 1/1885 Guffin et al. ..... 68/27
1,262,962 4/1918 Lewis ..... 68/26 X
1,878,254 9/1932 Warren ..... 68/27 X
2,368,586 1/1945 Vetorino ..... 68/27
2,787,150 4/1957 Sulzmann ..... 68/27
3,540,239 11/1970 Brenner ..... 68/27 X

FOREIGN PATENT DOCUMENTS 2538821 7/1984 France ..... 68/16
302895 12/1988 Japan ..... 68/27

*Primary Examiner*—Philip R. Coe
*Attorney, Agent, or Firm*—Burns, Doane, Swecker & Mathis

[57] ABSTRACT

A clothes washing machine includes a main washing/-spin-dry tub and an auxiliary tub in which clothes can be boiled. The auxiliary tub has its own water supply and a heater for heating the water. The auxiliary tub can be permanently attached to the main washer housing or it can be removable therefrom. A rotary drum can be disposed within the auxiliary tub, which drum can serve as a clothes dryer when free of water and with the heater actuated.

8 Claims, 9 Drawing Sheets

FULLY-AUTOMATED WASHING MACHINE

BACKGROUND OF THE INVENTION

1. Field of the Invention

The present invention relates to a fully-automated washing machine for performing a laundry washing.

2. Description of the Prior Art

Generally, in a conventional washing machine, as illustrated in FIG. 1, a body 1 of a washing machine is disposed with a tub 5 having a washing/spin-drying drum or tank 3 therein and a decelerater 9 is disposed underneath a center of the tub 5 for agitaing the laundry tossed into the washing/spin-drying drum by rotating clockwise and counter-clockwise the stirring blades 7 of a pulsator and the like installed on a floor within the drum 3.

The decelerator 9 is designed to receive a power in order to rotate the stirring blades 7 from a driving means 11 fixed to one end of a lower external side of the tub 5 through a power transfer means 13.

A drainage means 16 such as a solenoid valve and the like is disposed on a middle of a drainage pipe 15 underneath the tub 5 in order to discharge the laundry water in the washing/spin-drying drum to the outside.

Furthermore, on top surface area la of the body 1 of the washing machine, there is a lid 2 for covering an opening for insertion and removal of the laundry, and at the same time, on a rear side of the lid 2, in other words, on a lower rear side of a control panel 17, there is a detergent intake device 19 for dissolving and discharging a detergent into the drum 3.

In the washing machine thus constructed, when it is used by opening the lid 2 formed on the top surface area 1*a* of the body 1 and tossing the laundry into the drum 3, the water is supplied into the drum 3 and at the same time, the dissolved detergent is thrown into the drum from the detergent intake device 19.

When a predetermined quantity of water and detergent is supplied into the drum 3, the driving means 11 starts to operate. At this moment, a turning effect of the driving means 11 is transferred to the decelerator 9 through the power transfer means 13 and pulleys 12 and 14 to thereby rotate the decelerator 9 in opposite directions, so that the washing is performed by way of the currents of water formed by the oscillation of the stirring blades 7 attached to a driving axis of the decelerator 9.

Meanwhile, after the washing is finished, in accordance with an operation of the drainage means 16 attached to the drainage pipe 15, the water is discharged to the outside of the body 1, and in sequence, a washing cycle comprising another intermediate spin-dry, rinse, spin-dry and the like is automatically executed to thereby perform the laundry washing.

However, in the washing machine thus constructed to perform the washing by way of the water currents, organic or inorganic materials attached to the laundry can be separated to some extent, but insoluble organic or inorganic materials such as dirt, fat and the like can hardly be separated from the laundry solely by water currents.

Therefore, these kinds of insoluble foreign objects are separated by the detergent, in other words, by an assistance of a surface active agent for changing respective surface tensions of the water, fabrics and the foreign objects, to thereby be washed out. However, the foreign objects stuck to underwears, socks and other white-colored fabrics can not be washed thoroughly with the detergent, so that such laundry is first boiled in a separate container.

However, because a boiled washing method thus described is performed after the laundry, the detergent and the water are poured into a separate container to which heat is applied by gas, electricity and the like, a special attention should be always paid to avoid a burning of the laundry or danger of fire.

SUMMARY OF THE INVENTION

Accordingly, the present invention is presented to solve the problems intrinsically contained in the conventional washing machine thus constructed, and it is an object of the present invention to provide a fully-automated washing machine for performing not only a conventional laundry washing by way of the currents of water within a one-unit tub but also the boiling of the laundry.

It is another object of the present invention to provide a fully-automated washing machine which can do the washing calling for no additional hand washings after the boiling of the laundry and which can do an automatic drying as well.

In order to attain the aforementioned goals, according to the present invention, the fully-automated washing machine which can do an automatic washing, and drying comprises a body containing a washing/spin-dry tub and a pulsator rotatably driven by a driving source; and an auxiliary washing means mounted on one end of the body and having a heater.

BRIEF DESCRIPTION OF THE DRAWINGS

For a fuller understanding of the nature and objects of the invention, reference should be made to the following detailed description taken in conjunction with the accompanying drawings in which.

DETAILED DESCRIPTION OF THE INVENTION

Hereinafter, two embodiments of the present invention will be described in detail with reference to the accompanying drawings.

Figure 1:
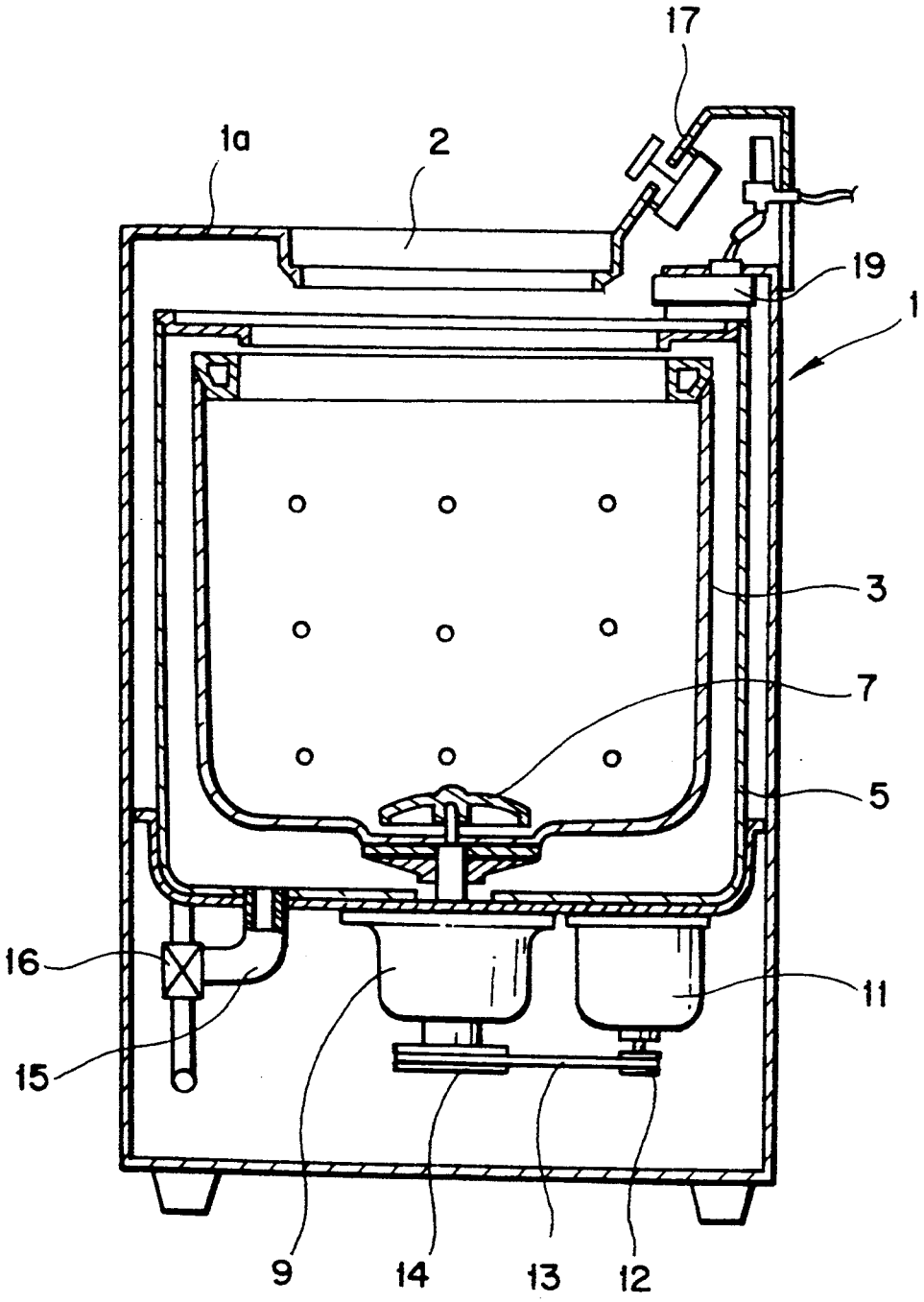
FIG. 1 PRIOR ART
FIG. 1 is a cross sectional view for illustrating an inner construction of a conventional fully-automated washing machine.
Figure 2:
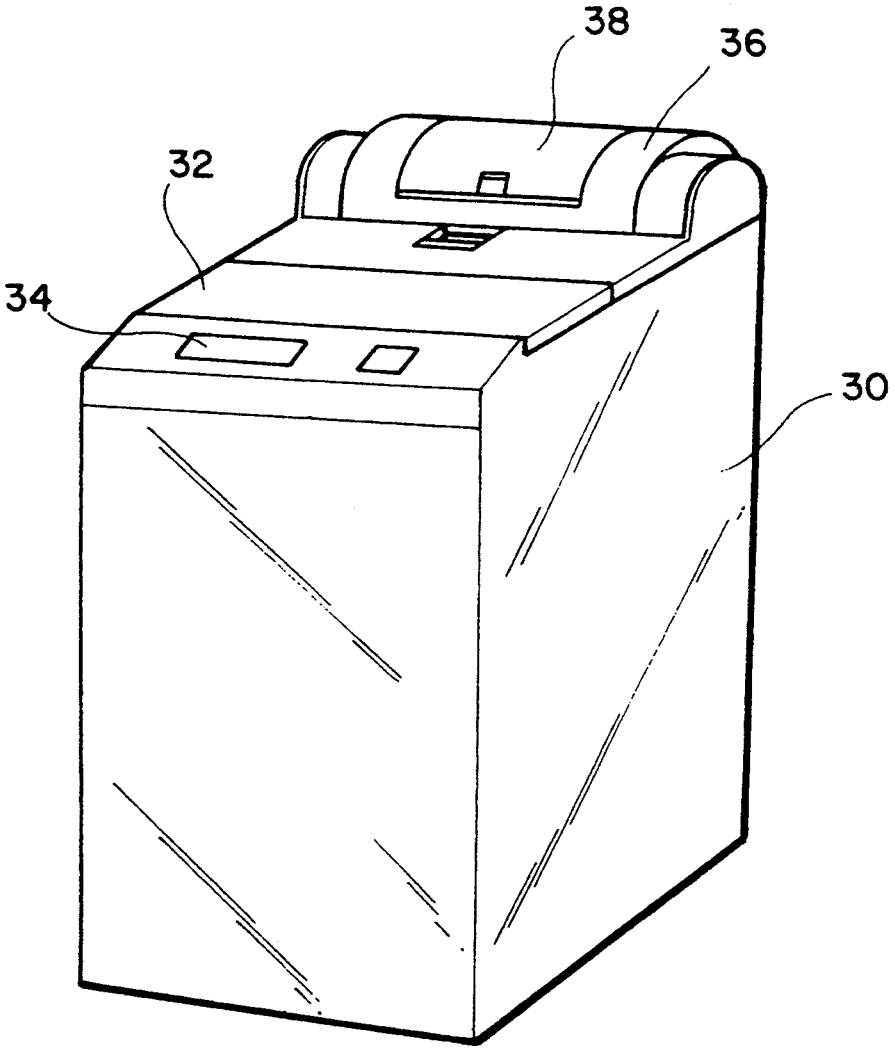
FIG. 2 is an external perspective view of a fully-automated washing machine in accordance with a first embodiment of the present invention.

As described in FIG. 2, a top side of the body 30 of the washing machine has a swingable lid 32 for covering an opening arranged for access to a main washing/-spin-dry tub 30*a* disposed within the body. On a front side of the washing machine body, there is disposed a control panel 34 for selectively controlling a laundering condition in accordance with kinds and volume of the laundry and behind the lid 32 there is provided an outer or auxiliary tub 36 for boiling the laundry.

An opening through which the laundry to be boiled can be tossed in and out is formed on the outer tub 36, and an external access door 38 is mounted on the outer tub 36 via a packing member to cover the tub 36 tightly.

Figure 3:
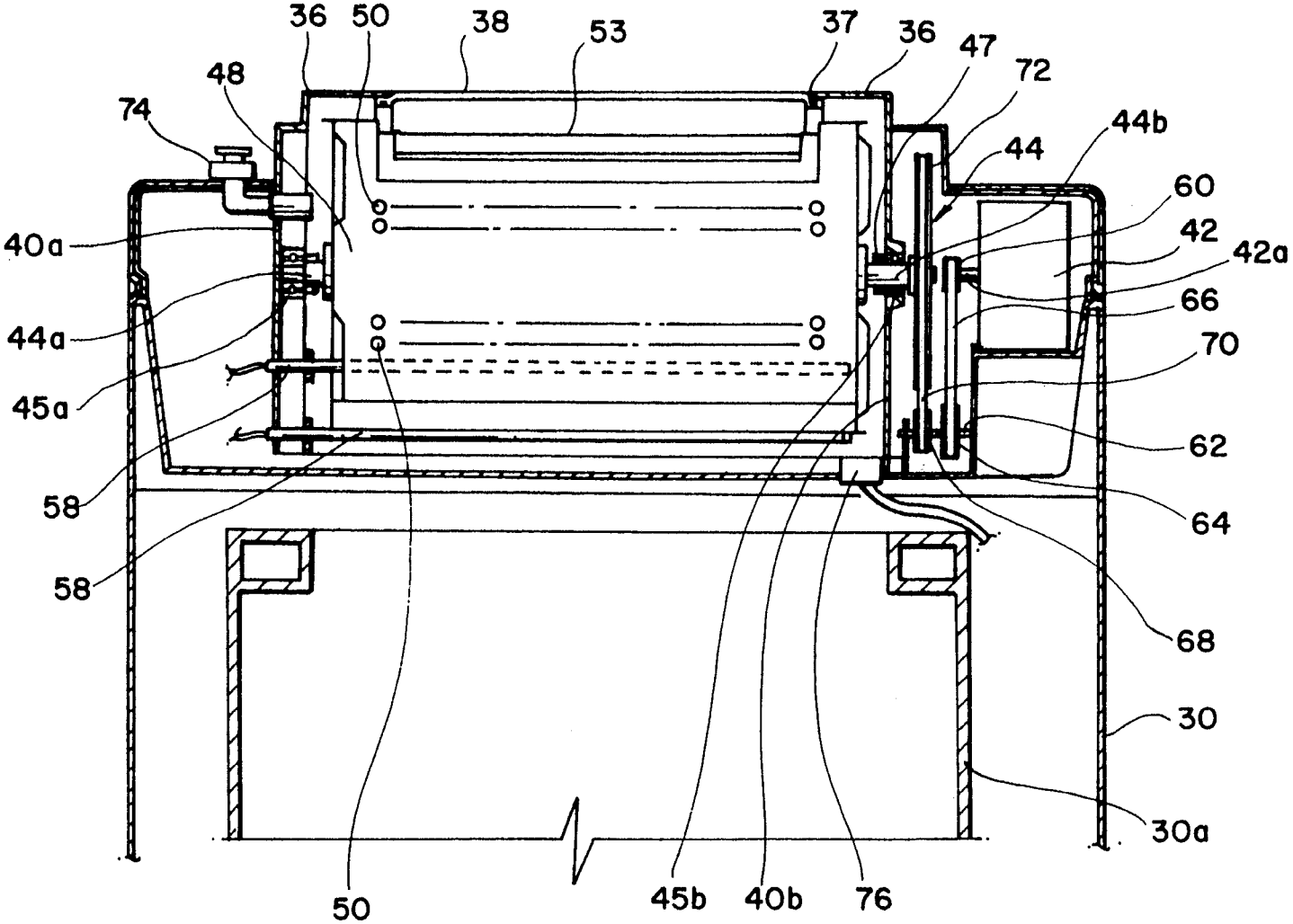
FIG. 3 is a fragmentary cross sectional view of FIG. 2.
Figure 4:
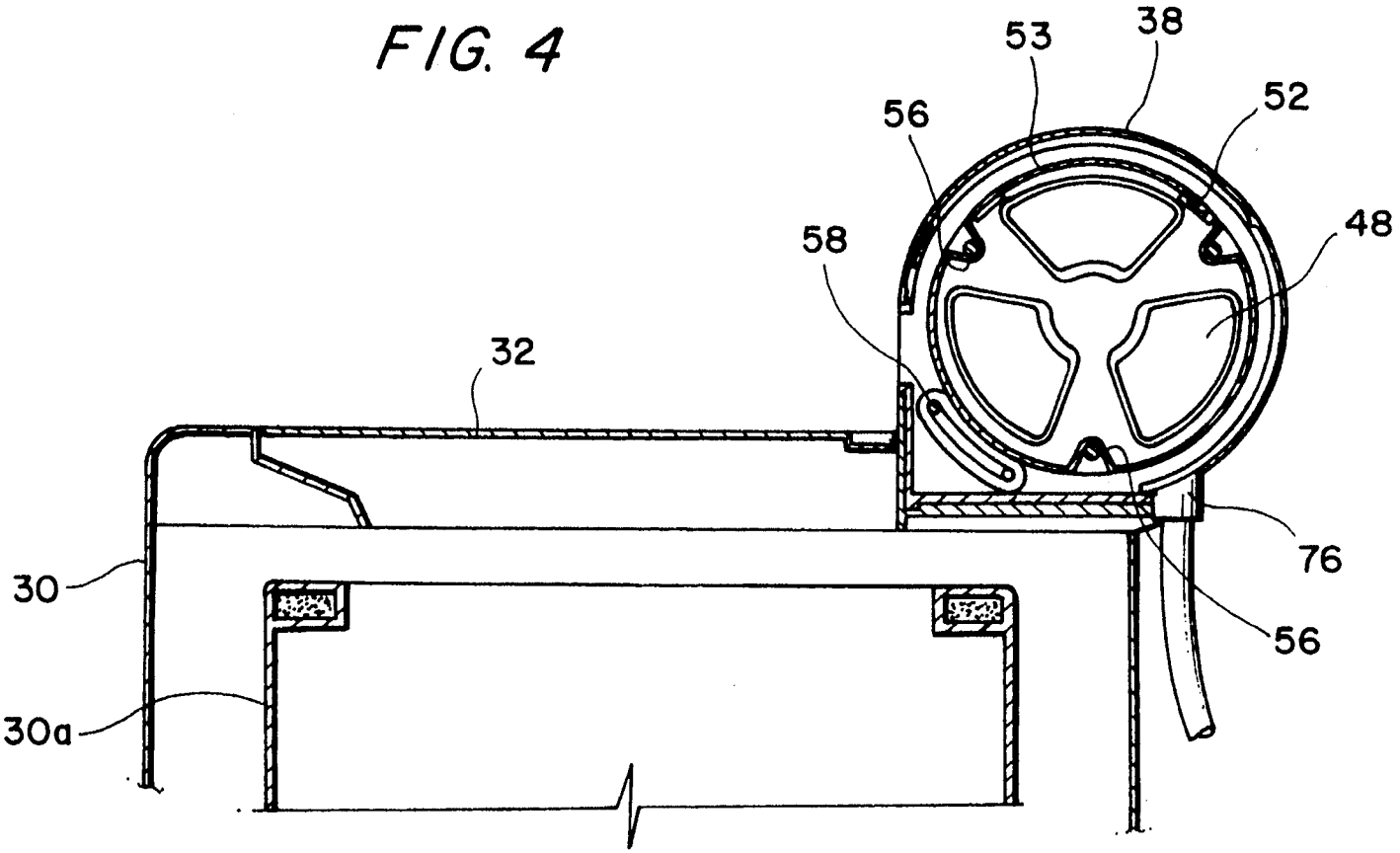
FIG. 4 is a sectional view taken along line 4—4' in FIG. 3.

Meanwhile, both ends of the outer tub 36, as illustrated in FIGS. 3 and 4, are fixed to a top side of the body 30 by a fastening means (not shown) or a welding.

On side walls 40*a* and 40*b* of the outer tub 36, a drum body 48 is rotatably and axially mounted by axles 44*a* and 44*b* and bearings 45*a* and 45*b*, so that the same can be rotated by a driving force from a power transfer means 44 in accordance with a rotation of a motor 42.

On an internal side of the bearing 45*b*, a packing member 47 is disposed, so that the laundry water in the outer tub 36 can not leak out.

A plurality of holes 50 are formed on a periphery of the drum body 48, and an internal door 53 mounted on the drum body is biased closed by a resilient means 54, so that the same can be rotatively opened and closed around a hinge pin 52. On an inner periphery of the drum there is formed a plurality of radially inwardly protruding members 56 extending axially, so that an impact force can be given to the laundry during a rotation to thereby increase the washing efficiency.

A heating means 58 is disposed between a lower area of the drum body 48 and the outer tub 36, so that the water within the outer tub 36 can be heated to thereby boil the laundry, or dry the laundry as will be hereinafter explained.

As will be appreciated, the outer tub 36 and the drum body 48 constitute a clothes dryer and an auxiliary washing means.

The outer tub 36 is disposed with a water supply means 74 for supplying the laundry water and a drainage means 76 for draining out the laundry water during washing and spin-drying cycles.

Figure 5:
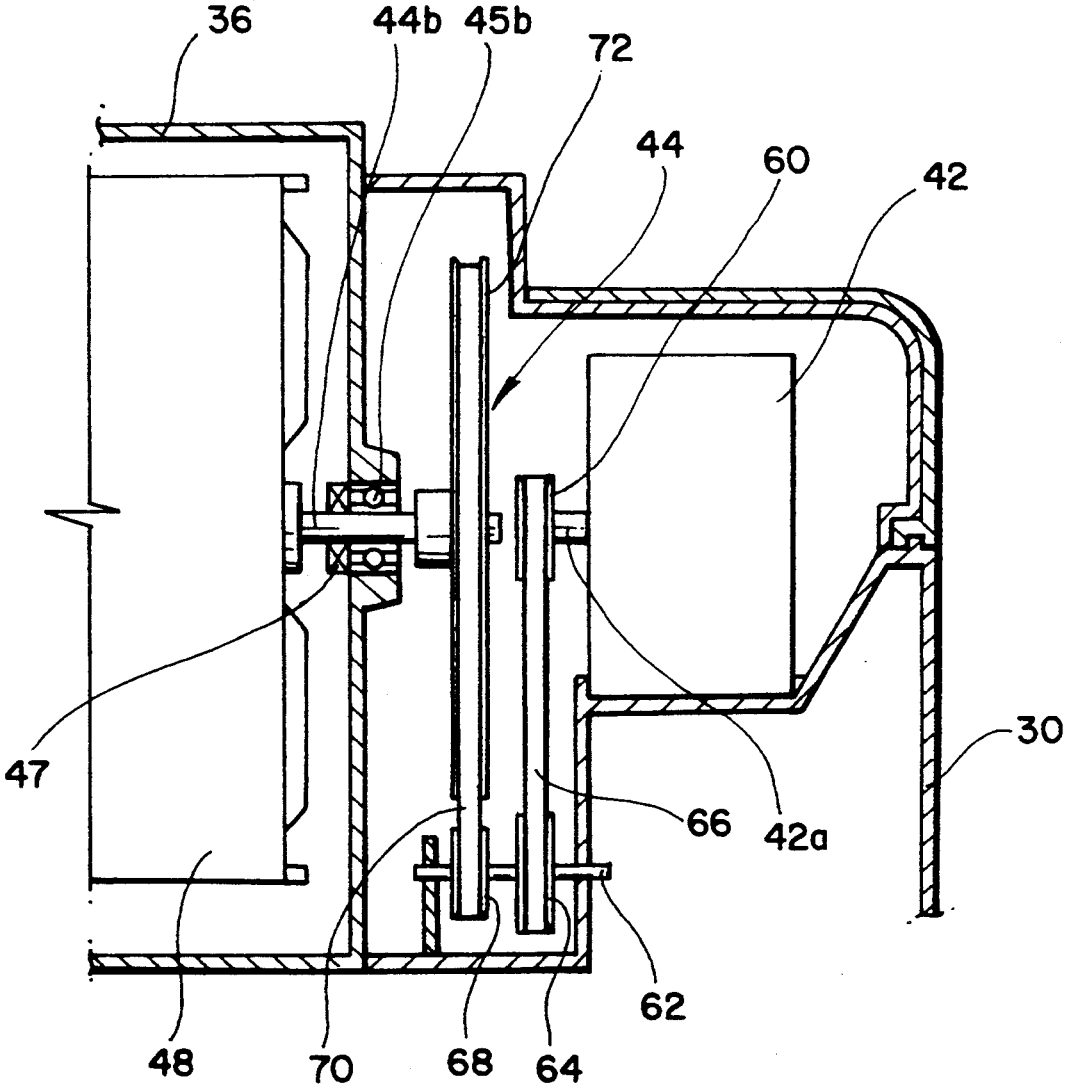
FIG. 5 is an enlarged sectional view for illustrating a power transfer means of the first embodiment of the present inveniton.
Figure 6:
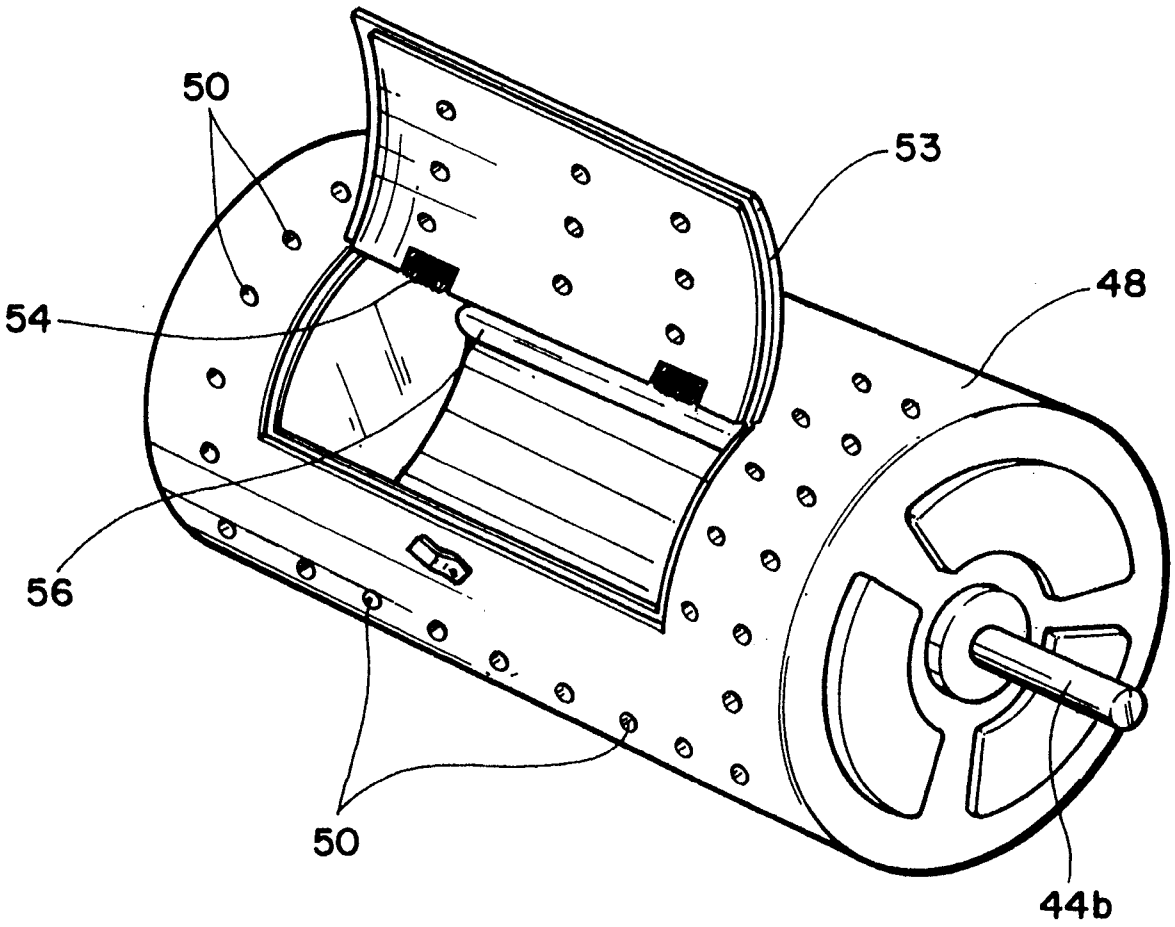
FIG. 6 is an enlarged side view of a drum body according to the first embodiment of the present invention.

Meanwhile, the power transfer means 44 for decreasing a turning effect of the motor 42 to thereby transfer proper rotational force to the drum body 48, as illustrated in FIG. 5, comprises: a driving pulley 60 mounted to a rotational axis 42*a* of the motor 42; a first pulley 64 fixed to a shaft 62; a first belt 66 for transferring the turning effect of the driving pulley 60 to the first pulley 64 by being suspended from the driving pulley 60 and the first pulley 64; a second pulley 68 disposed on the shaft 62, so that the same can be rotated by receiving a turning effect of the first pulley through the shaft 62; and a third pulley 72 for rotating a drum body 48 through the shaft 44*b* of the drum body 48 by receiving a turning effect of the second pulley 68 through a second belt 70 to thereby reduce the turning effect.

An operation of the fully-automated washing machine and an effect thereof thus constructed in accordance with the present invention will be described in the following.

First of all, an ordinary laundry which needs no boiling is tossed into the washing/spin-drying tub 30*a* by opening the lid 32, and then the lid 32 is closed, so that general washing conditions are selected by a control panel 34 to thereby perform the washing by the currents of water as in a conventional washing machine.

Furthermore, in order to boil the laundries such as underwears, socks and the like smeared with insoluble organic or inorgnic materials and filthy grimes, the external door 38 formed on a rear upper side of the body 30 is slid to open backwards and the internal door 53 of the drum body 48 is opened. The laundry to be boiled, the detergent and the like are tossed into the drum body 48, and then the internal door 53 and external door 38 are shut in that order, which finishes an input of the laundries.

Then, a laundry-boiling condition of the control panel 34 is selected, so that a predetermined adequate quantity of water is supplied to the outer tub 36 by the water supply means 74, and according to the activation of the motor 42, the turning effect thereof is transferred to the drum body 48 through the power transfer means 44, and simultaneously the power source is applied to the heating means 58 to thereby heat the water supplied to the outer tub 36.

In other words, when the motor 42 is rendered activated, the driving pulley is rotated, the turning effect of which is transferred to the first pulley 64 through the first belt 66.

According to the rotation of the first pulley, a turning effect of the second pulley 68 is effected which rotates the third pulley 72 through belt 70, to thereby rotate the drum body 48 at a reduced rotational speed.

At this point, because a plurality of protruding members 56 are formed lengthwise along the inner side of the drum body 48, the laundry is raised up to a predetermined height along the inner periphery of the drum body 48 by the members 56 when the drum body 48 is rotated, then the laundry falls down under a weight of the laundry itself to thereby receive an impact, so that a more effective washing can be achieved.

The temperature of the water rises up in accordance with the activation of the motor 42 and simultaneously with the heat by the heating means 58 to thereby rotate the laundry within the drum body 48 and the laundry is boiled for a predetermined period of time.

At this moment, the temperature of the water is detected by a temperature detecting means (not shown), and when the temperature of the water has been maintained beyond a predetermined temperature during a predetemined period of time, the power source is cut off to the heating means, so that the temperature of the water can not rise up beyond a preset temperature.

Even though the power source is cut off to the heating means 58, the motor keeps operating to thereby run the drum body 48 until the temperature of the water drops below the predetermined temperature.

As seen from the foregoing, when the boiling process is finished, the motor 42 becomes deactivated and at the same time, the rotation of the drum body 48 stops.

Thereinafter, in accordance with an activation of the drainage means 76 disposed on a lower side of the outer tub 36, the water is drained out. After the laundry water is drained out and when the water is re-supplied to the outer tub 36 by the water supply means 74, the drum body 48 is rotated to thereby perform a rinsing in accordance with the activation of the motor 42.

After these kinds of rinsing cycles are repeated several times, and when the water is drained out through the drainage means 76, the boiling cycle of the laundry is finished. After boiling/washing cycle is finished, the laundry is taken out of the drum body 48 and tossed into the washing/spin-dry tub 30*a* disposed in the body 30, so that the conventional spin-dry cycle can be performed.

Afterwards, when the spin-dry is finished, the laundry is re-tossed into the drum body 48, so that the laundry can be dried by way of heat waves generated by the rotation of the drum body 48 and activation of the heating means 58.

When the drying is thus performed, no water is supplied into the outer tub 36 but the motor is rotated and the drum body 48 receives the driving power of the motor through the power transfer means 44 to thereby swiftly spin-dry the laundry.

As seen in the aforesaid, in accordance with the fully-automated washing machine described in the first embodiment of the present invention, the laundries such as the underwears, socks and the like which have to be periodically boiled can be boiled in one washing machine, and at the same time, the conventional laundering can be performed, which is very handy and convenient. Even during the boiling, the laundering effect can be enhanced because the laundry receives impacts generated by the plurality of the protruding members formed on the inner side in accordance with the rotation of the drum body. The boiled laundering can also perform the spin-drying by the heating means mounted within the outer tub. Because the construction is simple, the manufacturing of the washing machine is easy.

Next, a fully-automated washing machine in accordance with a second embodiment of the present invention will be described in detail.

Figure 7:
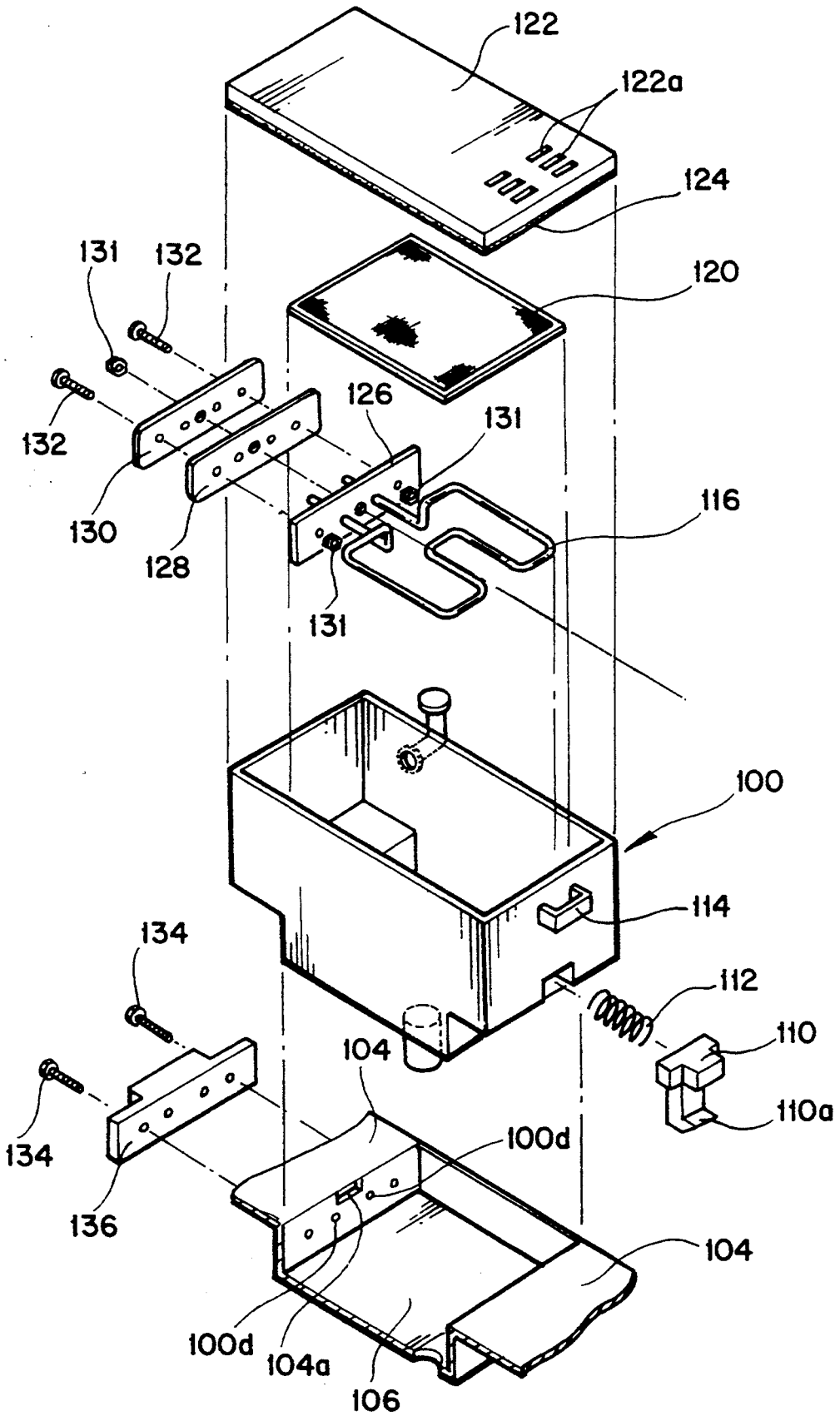
FIG. 7 is an exploded perspective view of a boiling tank in accordance with a second embodiment of the present invention.
Figure 8:
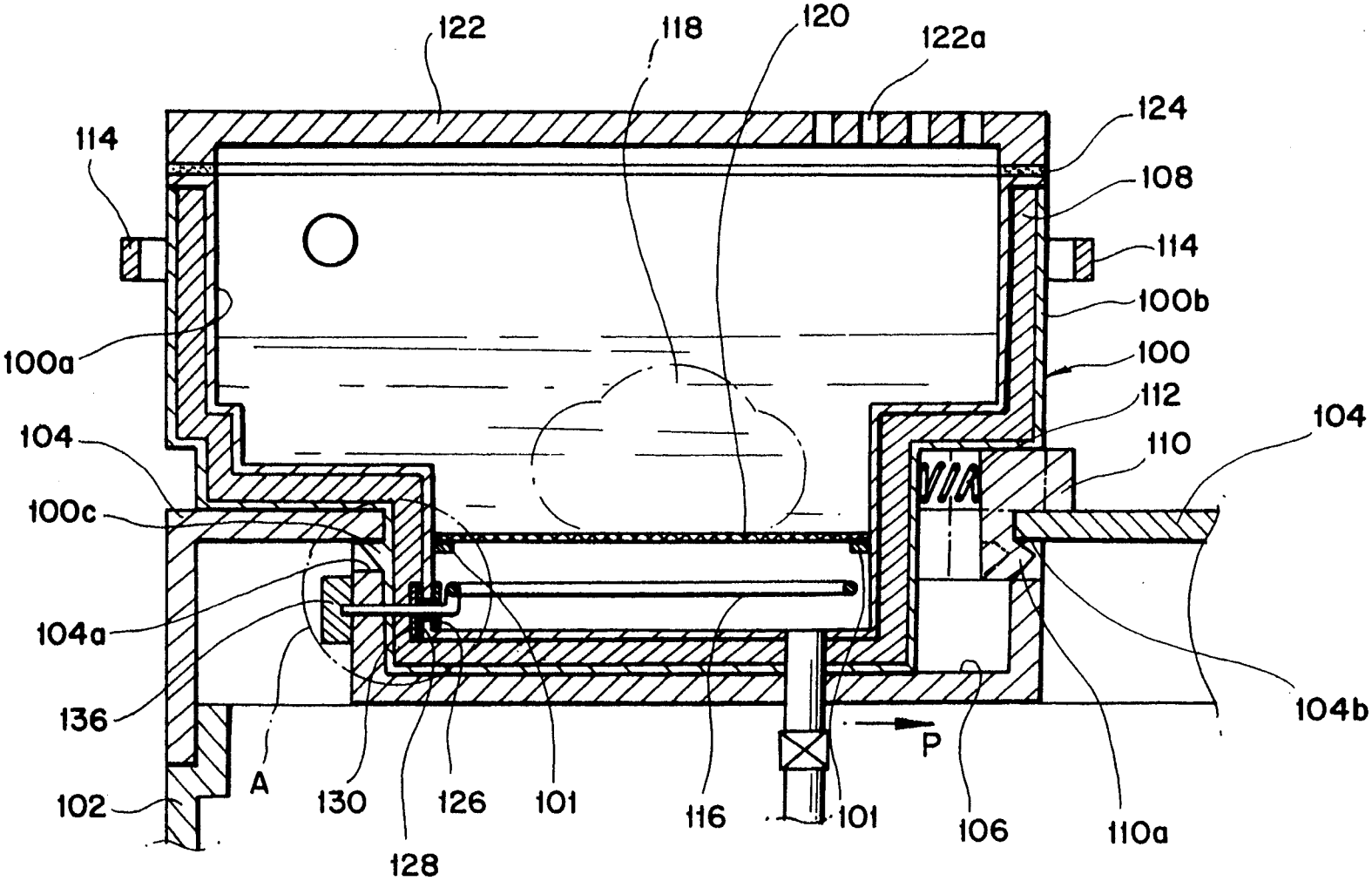
FIG. 8 is a cross sectional view for illustrating an assembled state of FIG. 7.

As illustrated in FIGS. 7 and 8, an auxiliary heating tub 100 is detachably disposed within a concaved groove 106 formed on a top surface plate 104 of a body 102 of the washing machine.

The heating tub 100 consists of an inner tub 100*a* and an outer tub 100*b*, and therebetween, an insulation material 108 made of fiber glass or ceramic materials is stuffed in order to prevent the heat of the inner tub 100*a* from radiating to the exterior.

On one end of the outer tub 100*b*, a protruding lug 100*c* is formed which projects into a hole 104*a* formed on a top surface plate 104 of the body 102 in order to avoid a swaying of the heating tub 100. On an opposite end of the outer tub there is arranged a button 110 having a lug 110*a* connectedly fitted into an insertion hole 104*b* formed on the top surface plate 104. The button 110 is resiliently biased outwardly by a resilient member 112.

Furthermore, on the outer tub 100*b* of the heating tub 100, a knob 114 is disposed for lifting out the heating tub 100 from the concave groove 106 formed on the top surface plate 104, and within the heating tub 100 at a lower portion thereof, a heating means 116 is fixedly mounted.

Extending over the heating means 116 is a middle panel 120 made of a stainless iron plate or stainless mesh formed with a plurality of holes. The panel 120 sits on a protruding lug 101 jutted out from the inner tub 100*a* in order to prevent the foreign objects or laundries 118 separated from the laundry during the heating from directly touching the heating means 116.

Meanwhile, a cover 122 formed with ventilation holes 112*a* for discharging vapors produced from the boiling of the laundry is disposed on the opening formed at the top of the heating tub 100.

A packing member 124 made of a silicon rubber and the like is attached underneath the periphery of the cover 122.

The heating tub 100 and the cover 122 comprise an auxiliary laundry means.

The heater 116 extends tightly through an insulation panel 126*a*, packing member 128 and a fixed panel 130 which are fastened by a set bolt 132 and a nut 131 to a side wall of the inner tub 100*a*. An outlet 136 functioning as a power supply means to supply a power to the heating means 116 is fixed on an outer side of the concave groove 106 formed at the top plate 104 by means of a bolt 134.

Figure 9:
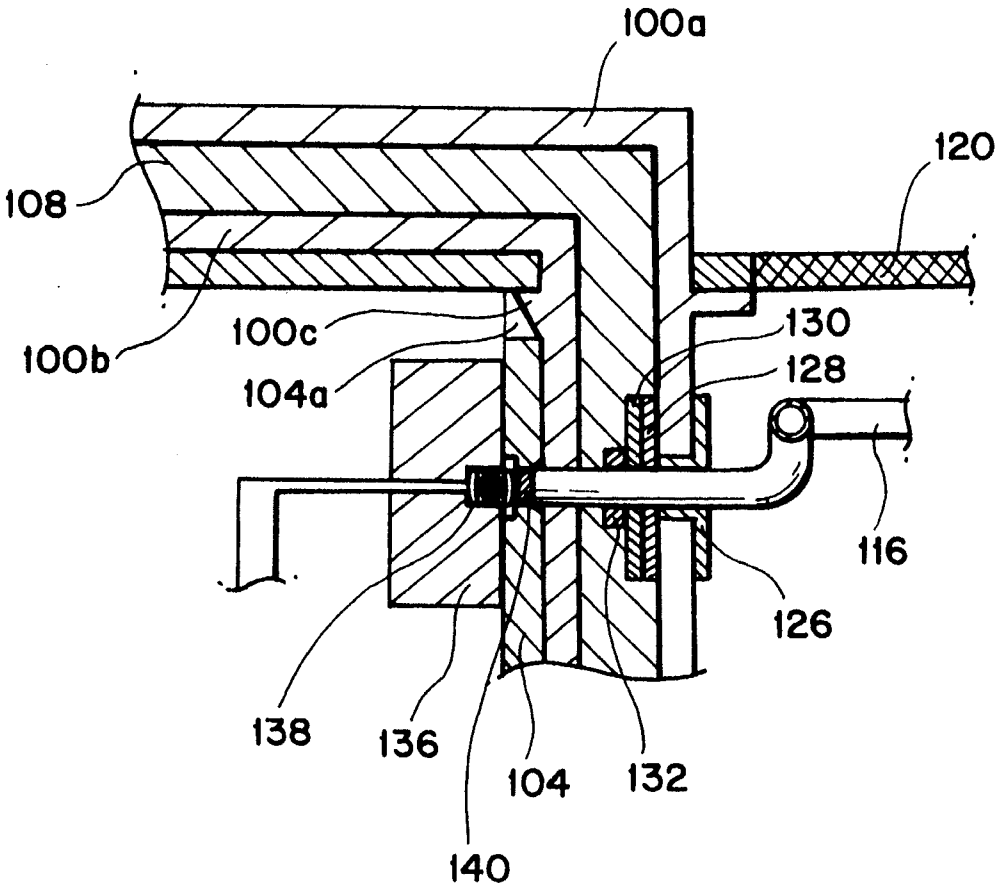
FIG. 9 is an enlarged view of a section "A" in FIG. 8.

As shown in FIG. 9, there is disposed inside the outlet 136, a spring 138 made of a material of good conductivity and arranged to have a good electrical contact with the heating means 116. On a front tip of the spring 138, a point of contact 140 is disposed in order to contact the heating means 116 electrically.

An operational sequence and effect thereof for the fully-automated washing machine in accordance with the second embodiment of the present invention thus constructed will be described in the following.

First of all, when the tub 100 is lowered into the groove 106, the button 110 is pressed in, and the protruding lug 100*c* is inserted within the insertion hole 104*a*. At the same time, one end of the heating means 116 is inserted into perforations 100*d* formed in the top surface plate 104 to thereby maintain an electrical contact with the point of contact disposed at the front tip of the spring 138.

Next, the laundries such as the underwears, socks and the like which are supposed to be boiled and a predetermined quantity of water are introduced into the heating tub 100 along with the detergent, the cover 122 is closed, and a button disposed on the control panel is pressed to thereby select the boiling laundry cycle. Then, a power is applied to the heating means 116 to apply heat to the water.

Accordingly, the inorganic or organic soluble foreign objects attached or smeared with the laundries can be easily separated by the water heated with a predetermined temperature, along with the insoluble organic or inorganic materials.

During the activation of the heating means 116, the insulated material 108 stuffed between the inner tub 100*a* and the outer tub 110*b* of the heating tub 100, prevents heat from radiating to the outside.

When the laundry water is boiled, the vapors generated are easily discharged through the plurality of perforations 122*a* formed at one end of the access cover or door 122, so that the water is prevented from overflowing.

Furthermore, the middle panel 120 prevents the laundries from contacting the heating means 116 to thereby prevent the laundries from being burnt during the washing cycle.

Meanwhile, the insulation panel 126, packing member 128 and the fixed panel 130 fix the heating means 116 by way of the set bolt 132 and nut 131, so that the laundry water in the inner tub 100*a* will not leak out.

In the aforesaid description, when the laundry is boiled the laundry water is checked by a detecting means for the temperature, which is inputted to a control means (not shown), so that the power applied to the heating means 116 is cut off, and at the same time, a warning device (not shown) is activated to give forth an alarm advising that the laundry-boiling process is finished.

Next, when there is a warning sound that the boiling of laundry is finished, the button 110 disposed on the outer side of the heating tub 100 is pressed to thereby release an engagement between the lug 110*a* and the insertion hole 104*b*, then the heating tub 100 is pushed in an arrow direction P to thereby release the engagement between the heating means 116 and the point of contact at the outlet 136, so that the heating tub 100 can be separated from the concave groove 106 of the top surface panel 104.

After the heating tub 100 is separated from the body of the washing machine, the boiled laundries contained in the heating tub 100 are transferred to the washing tub 30*a*, so that the washing/spin-drying cycle can be conventionally performed by the water currents to thereby finish the whole washing processes.

As seen in the foregoing, according to the fully-automated washing machine described in the second embodiment of the present invention, the conventional washing by currents can be performed and at the same time, after the laundries, the water and detergent are introduced into the heating tub and a washing cycle is selected on the control panel, the laundry water is heated by the radiation of heat from the heating means to thereby achieve a markedly efficient result of boiling the laundries.

What is claimed is:

1. An automatic clothes washing machine, comprising:

a body including a top side and a main access door formed in said top side;

a main clothes washing means comprising a main tub disposed in said body for washing and spin-drying clothes, said main tub arranged to be accessed by said main access door;

an auxiliary clothes washing means mounted to said body in spaced relationship to said main tub and including water supply and draining means and heating means for heating water supplied to said auxiliary washing means for washing clothes in boiled water, said auxiliary washing means disposed on said top side of said body at a location spaced from said main access door and including an auxiliary tub mounted to said body and having an access door, a drum mounted for rotation in said auxiliary tub about a substantially horizontal axis, said drum including an access door, said drum including a radially inwardly projecting element extending lengthwise of said drum for raising clothes as said drum rotates; and drive means for driving said main and auxiliary clothes washing machines independently of one another.

2. An automatic clothes washing machine according to claim 1, wherein said heating means is situated inside of said auxiliary tub beneath said drum.

3. An automatic clothes washing machine according claim 2, wherein said drum is perforated.

4. An automatic clothes washing machine according to claim 1, wherein said heating means is disposed within said auxiliary tub.

5. An automatic clothes washing machine according to claim 1, wherein said auxiliary washing means is removable from said body.

6. An automatic clothes washing machine comprising;

a body;

a main clothes washing means comprising a main tub disposed in said body for washing and spin-drying clothes; and an auxiliary clothes washing means removably mounted to said body in spaced relationship to said main tub and including water supply and draining means and heating means for heating water supplied to said auxiliary washing means, wherein said auxiliary washing means includes an auxiliary tub insertable into a recess formed in said body, said heating means being electrical and disposed within said auxiliary tub, a portion of said heating means projecting through a wall of said auxiliary tub and defining a plug-in element, said body including an electrical connector into which said plug-in element can be plugged when said auxiliary tub is inserted into said recess.

7. An automatic clothes washing machine according to claim 6 including a releasable element for connecting said auxiliary tub to said body.

8. An automatic clothes washing machine according to claim 7, wherein said heating means is disposed in a lower portion of said auxiliary tub, and a perforated panel overlies said heating means to segregate the clothes from said heating means.

* * * * *